US006621232B2

(12) United States Patent
Jo et al.

(10) Patent No.: US 6,621,232 B2
(45) Date of Patent: Sep. 16, 2003

(54) FIELD EMISSION DISPLAY DEVICE HAVING CARBON-BASED EMITTER

(75) Inventors: Sung-Ho Jo, Seongnam (KR); You-Jong Kim, Suwon (KR); Sang-Jo Lee, Kyungki-do (KR); Jae-Cheol Cha, Seoul (KR); Jong-Min Kim, Suwon (KR)

(73) Assignee: Samsung SDI Co., Ltd., Suwon (KR)

( * ) Notice: Subject to any disclaimer, the term of this patent is extended or adjusted under 35 U.S.C. 154(b) by 0 days.

(21) Appl. No.: 10/155,732

(22) Filed: May 28, 2002

(65) Prior Publication Data

US 2003/0127988 A1 Jul. 10, 2003

Related U.S. Application Data

(60) Provisional application No. 60/344,332, filed on Jan. 4, 2002.

(51) Int. Cl.[7] ..... G09G 3/10; G09G 3/30; H01J 1/62

(52) U.S. Cl. ..... 315/169.3; 315/169.4; 313/492; 313/495; 313/498; 345/76; 345/77; 345/63

(58) Field of Search ..... 315/169.3, 169.4, 315/169.1; 313/495, 492, 491, 483, 484, 498, 506, 509; 345/76, 74, 75, 77, 60, 63

(56) References Cited

U.S. PATENT DOCUMENTS 6,380,671 B1 * 4/2002 Lee ..... 313/495
6,384,542 B2 * 5/2002 Tsukamoto ..... 315/169.3

* cited by examiner

*Primary Examiner*—Don Wong
*Assistant Examiner*—Tuyet T. Vo
(74) *Attorney, Agent, or Firm*—McGuireWoods LLP

(57) ABSTRACT

A field emission display includes a first substrate; a plurality of gate electrodes formed on the first substrate in a predetermined pattern; an insulation layer formed covering the gate electrodes over an entire surface of the first substrate; a plurality of cathode electrodes formed on the insulation layer in a predetermined pattern, a plurality of emitters formed on the cathode electrodes; a plurality of counter electrodes formed on the insulation layer at a predetermined distance from the emitters and in a state of electrical connection to the gate electrodes, the counter electrodes forming an electric field directed toward the emitters; a second substrate provided at a predetermined distance from the first substrate and sealed in a vacuum state with the first substrate; an anode electrode formed on a surface of the second substrate opposing the first substrate; and a plurality of phosphor layers formed over the anode electrode in a predetermined pattern.

23 Claims, 4 Drawing Sheets

FIELD EMISSION DISPLAY DEVICE HAVING CARBON-BASED EMITTER

CROSS REFERENCE TO RELATED APPLICATION

This Application is based on U.S. Provisional Application No. 60/344,332 filed on Jan. 4, 2002, herein incorporated by reference in its entirety.

BACKGROUND OF THE INVENTION (a) Field of the Invention

The present invention relates to a field emission display, and more particularly, to a field emission display having a carbon-based emitter.

(b) Description of the Related Art

A field emission display (FED) uses a cold cathode as the source for emitting electrons. The overall quality of the FED depends on the characteristics of emitters, which is for an electron emission layer. The first FEDs utilized emitters made mainly of molybdenum (Mo). Subsequently, Spindt-type metal tip emitters were developed. An example of this prior art technology is disclosed in U.S. Pat. No. 3,789,471, which is related to a display system having a field emission cathode.

However, a semiconductor fabrication process is used to manufacture the FED having a metal tip emitter. Such process includes photolithography and etching processes to form a hole that accommodates an emitter as well as deposition of molybdenum to form metal tips. This requires not only advanced technologies but also expensive equipment, increasing the manufacturing costs. These factors make mass production of these types of FEDs difficult.

Accordingly, much research has been done to form emitters in a flat configuration that enables electron emission at a low voltage (around 10□50V), and simple manufacture. It is known that carbon-based materials, for example graphite, diamond, DLC (diamond-like carbon), $C_{60}$ (Fullerene), or CNT (carbon nanotube), are suitable for planar emitters. In particular, it is believed that CNT, is the ideal material for emitters in field emission displays because of its relatively low driving voltage. U.S. Pat. Nos. 6,062,931 and 6,097,138 disclose cold cathode field emission displays that are related to this area of FEDs using CNT technology.

The FEDs disclosed in these patents employ a triode structure in which the gate electrode is provided between the cathode electrode and an anode electrode.

However, when the triode structured FED adopts carbon-based material, like carbon nanotubes, as emitting material, it is difficult to precisely form the emitters into the gate holes of the insulation layer between cathode electrode and gate electrode. In particular, it is extremely difficult to provide the paste in the minute holes for formation of the emitters using a printing process.

There have been recent efforts to solve these problems by different arrangement of electrodes. U.S. Patent Application Publication Pub. No. 2001/0006232 A1 discloses an FED that provides a gate electrode between a substrate and a cathode electrode. In this type of FED, the emitters of carbonbased materials may be easily formed by printing process, since the emitters are provided on the uppermost portion of the substrate as the gate electrode has changed its position. As a result, mass production became possible.

Various positions where to locate the gate eletrode and the emitter and their relationships have been disclosed in the U.S. patent application Ser. No. 09/967,936 filed Oct. 2, 2001, which was assigned to the same assignee of the present Application, and which is hereby incorporated by reference.

However, it is necessary to apply a high voltage to the gate electrode, in order to form a sufficient electrical field for electron emission, since the gate electrode is covered by an insulation layer. Otherwise, the cathode electrode should have large spacing between each other, that causes charge accumulation in insulation layer and abnormal irradiation of phosphor.

SUMMARY OF THE INVENTION

The present invention has been made in an effort to solve the above problems.

It is an object of the present invention to provide a field emission display that achieves good picture quality while obtaining sufficient field emission without increasing a voltage to drive a gate electrode.

To achieve the above object, the present invention provides a field emission display including a first substrate; a plurality of gate electrodes formed on the first substrate in a predetermined pattern; an insulation layer formed over the entire surface of the first substrate covering the gate electrodes; a plurality of cathode electrodes formed on the insulation layer in a predetermined pattern, a plurality of emitters being formed on the cathode electrodes; a plurality of counter electrodes which are electrically connected to the gate electrodes making an electric field directed toward the emitters formed on the insulation layer at a predetermined distance from the emitters, a second substrate provided at a predetermined distance from the first substrate and sealed in a vacuum state with the first substrate; an anode electrode formed on a surface of the second substrate opposing the first substrate; and a plurality of phosphor layers formed over the anode electrode in a predetermined pattern.

The electrical connection between the counter electrodes and the gate electrodes is realized by the holes through the insulation layer. The connection part may be made of the same material as the counter electrodes or other conductive materials.

It is preferable that a suitable distance between counter electrodes and the cathode electrodes be maintained to form an electric field for optimal electron emission. In addition, it is preferable that the counter electrodes are higher than the cathode electrodes to form an electric field for optimal electron emission.

Also, it is preferable that surfaces of the counter electrode and emitter facing each other are unevenly formed in a saw-tooth configuration or in a rounded formation.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION OF THE PREFERRED EMBODIMENTS

Preferred embodiments of the present invention will now be described in detail with reference to the accompanying drawings.

Figure 1:
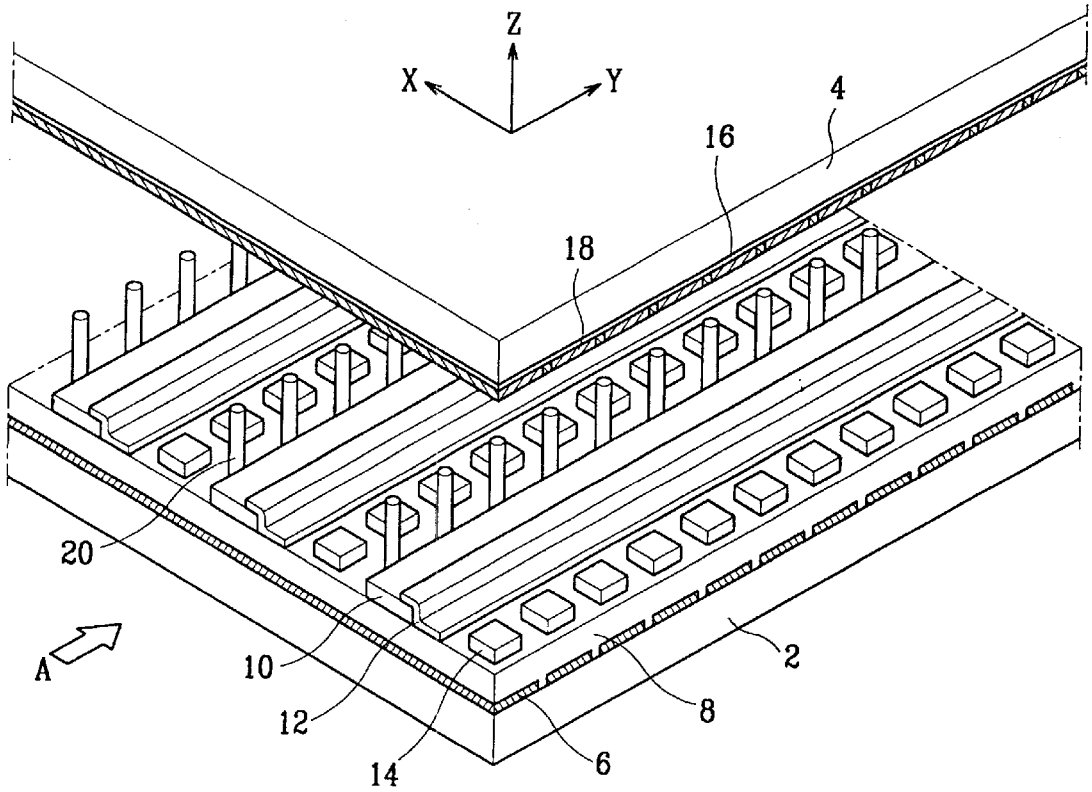
FIG. 1 is partial perspective view of a field emission display according to a first preferred embodiment of the present invention.
Figure 2:
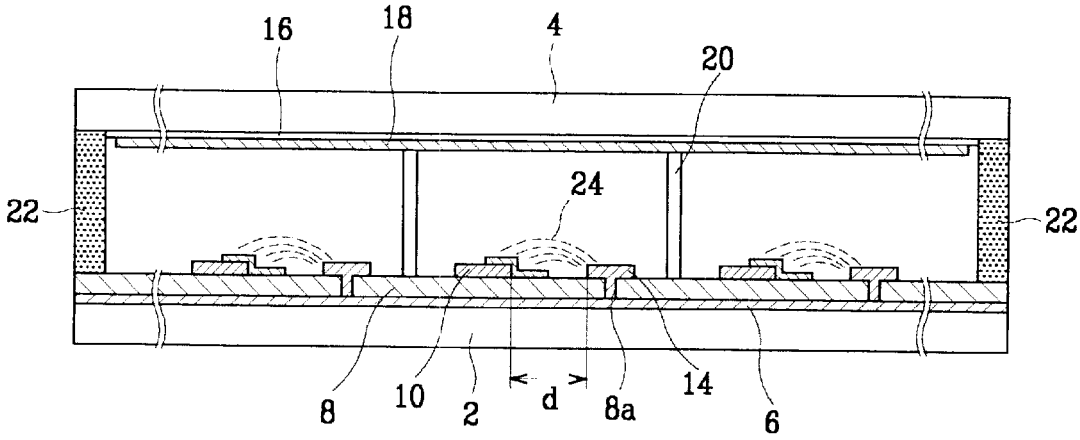
FIG. 2 is a sectional view of the field emission display shown in FIG. 1.

FIG. 1 is partial perspective view of a field emission display according to a first preferred embodiment of the present invention, and FIG. 2 is a sectional view of the field emission display taken in direction A of FIG. 1.

As shown in the drawings, the FED according to the first preferred embodiment of the present invention includes a first substrate 2 of predetermined dimensions and a second substrate 4 of predetermined dimensions. The second substrate 4 is provided substantially in parallel to and at a certain distance apart from the first substrate 2 to form a gap between the first substrate 2 and the second substrates 4. The first substrate 2 will hereinafter be referred to as a rear substrate and the second substrate 4 will hereinafter be referred to as a front substrate.

A structure that generates an electric field is provided on the rear substrate 2 and a structure that forms predetermined images by electrons emitted from the electric field is provided on the front substrate 4. This will be described in more detail below.

A plurality of gate electrodes 6 is formed on the rear substrate 2 in a predetermined pattern. In the first preferred embodiment of the present invention, the gate electrodes 6 are formed in a stripe pattern along direction X of FIG. 1 at predetermined intervals. Further, an insulation layer 8 is formed covering the gate electrodes 6 over an entire surface of the rear substrate 2. It is preferable that the insulation layer 8 is made of a vitreous material such as $SiO_2$, polyimide, nitride, a compound of these elements, or made of a structure having these materials layered.

A plurality of cathode electrodes 10 is formed on the insulation layer 8. In the first preferred embodiment of the present invention, the cathode electrodes 10 are formed in a stripe pattern along direction Y of FIG. 1 at predetermined intervals. Accordingly, the cathode electrodes 10 are perpendicular to the gate electrodes 6.

Further, emitters 12 are formed on the cathode electrodes. The emitters 12 emit electrons by generating an electric-field in pixel areas of the rear substrate 2. In the first preferred embodiment of the present invention, each of the emitters 12 is formed covering one edge of cathode electrode and part of insulating layer. This is only one example of how the emitters 12 may be formed on the insulation, and the emitters 12 may be formed in different configurations. For example, each of the emitters 12 may be formed on a center portion of the cathode electrodes 10, on one edge of the cathode electrodes 10, or both edges of the cathode electrodes 10.

Emitters 12 are made of a carbon based material, for example, carbon nanotubes, $C_{60}$ (Fullerene), diamond, DLC (diamond-like carbon), or a combination of these materials. For manufacturing emitters 12, a screen-printing process, a chemical vapor deposition (CVD) method, or a sputtering method may be used. In the first preferred embodiment of the present invention, carbon nanotubes and a screen-printing process is used.

Also a plurality of counter electrodes 14 are formed on the insulation layer 8 in the pixel area. When the driving voltage is applied to the gate electrodes 6, additional electric field is formed between the counter electrodes 14 and the emitters 12. In this manner, counter electrodes generate desirable amounts of electron emissions from the emitters.

Preferably the counter electrodes 14 are quadrilateral and are provided in the pixel regions (as described above) between the cathode electrodes 10.

The counter electrodes 14 may be formed in other shapes.

The counter electrodes 14 are electrically connected to the gate electrodes 6. The counter electrodes are electrically connected to the gate electrodes via holes through the insulation layer. The connection part may be made of the same material as the counter electrodes or other conductive materials. In addition, the holes 8*a* are formed corresponding to the mounting positions of the counter electrodes 14 by a printing process or a photolithography process, etc.

A hole can be formed by printing a layer of insulating materials in a perpendricular direction leaving an area for a hole.

On the other hand, an anode electrodes R,G,B phosphor layers 18 are formed on the front substrate. The anode electrodes are preferably made of ITO (indium tin oxide) and patterned at a predetermined interval along direction X in FIG. 1.

The rear substrate 2 and the front substrate 4 are provided substantially in parallel with each other and they have a predetermined gap therebetween as described above. And the cathodes are positioned perpendicular to the anode electrodes. The rear substrate 2 and the front substrate 4 are sealed using a sealing material 22 applied around a circumference of the rear substrate 2 and the front substrate 4, producing a single, integrally formed device. Also, a plurality of spacers 20 are provided between the front substrate 2 and the rear substrate 4 in non-pixel area. The spacers 20 maintain the predetermined gap between the front substrate 2 and rear substrate 4 uniformly over the entire area.

In the FED structured as in the above, when a predetermined voltage is applied to the anode electrode 16, the cathode electrodes 10, and the gate electrodes 6, an electric field is generated between the gate electrodes 6 and the emitters 12, and electrons are emitted from the emitters 12. The emitted electrons are induced toward the phosphor layers 18 to strike the same. As a result, the phosphor layers 18 are illuminated and form predetermined images.

During this operation, the voltage of the gate electrodes 6 is also applied to the counter electrodes 14. This creates an electric field of a predetermined magnitude between the emitters 12 and the counter electrodes 14. This additional electric field complements the electric field formed between the emitters 12 and the gate electrodes 6. Accordingly, more electrons are emitted from the emitters 12. In FIG. 2, reference numeral 24 indicates the additional electrical field formed between the emitters 12 and the counter electrodes 14.

Therefore, in the FED structured and operating as in the above, a greater number of electrons are emitted at a relatively low gate voltage as a result of the additional electric field generated between the emitters 12 and the counter electrodes 14. Stated differently, an equal amount of electric field may be generated in the first preferred embodiment of the present invention by applying a lower voltage than in the prior art.

With respect to the mounting of the counter electrodes 14 on the insulation layer 8, it is preferable that a proper distance (d) is maintained from the cathode electrodes 10 as shown in FIG. 2.

Table 1 below shows variations in the magnitude of the electric field (E) with changes in the distance (d) between the cathode electrodes 10 and the counter electrodes 14. Two figures are given for each change in distance (d)—a figure for when a drive voltage is applied to the gate electrodes 6 (gate electrode On) and a figure for when a drive voltage is not applied to the gate electrodes 6 (gate electrode Off).

TABLE 1

| No. | d(μm) | E1(V/μm) Gate electrode On | E2(V/μm) Gate electrode Off |
|---|---|---|---|
| 1 | 200 | 6.7907 | 2.1464 |
| 2 | 150 | 6.7503 | 2.0784 |
| 3 | 100 | 6.6897 | 1.9456 |
| 4 | 90 | 6.6801 | 1.9010 |
| 5 | 80 | 6.6754 | 1.8539 |
| 6 | 70 | 6.6808 | 1.7914 |
| 7 | 60 | 6.7058 | 1.7195 |
| 8 | 50 | 6.7729 | 1.6246 |

The above calculations were made under the conditions of applying 1,000V to the anode electrode 16, 0V to the cathode electrodes 10, 100V to the gate electrode 6 when the gate electrodes 6 are On, and 0V to the gate electrode 6 when the same are Off.

Figure 3:
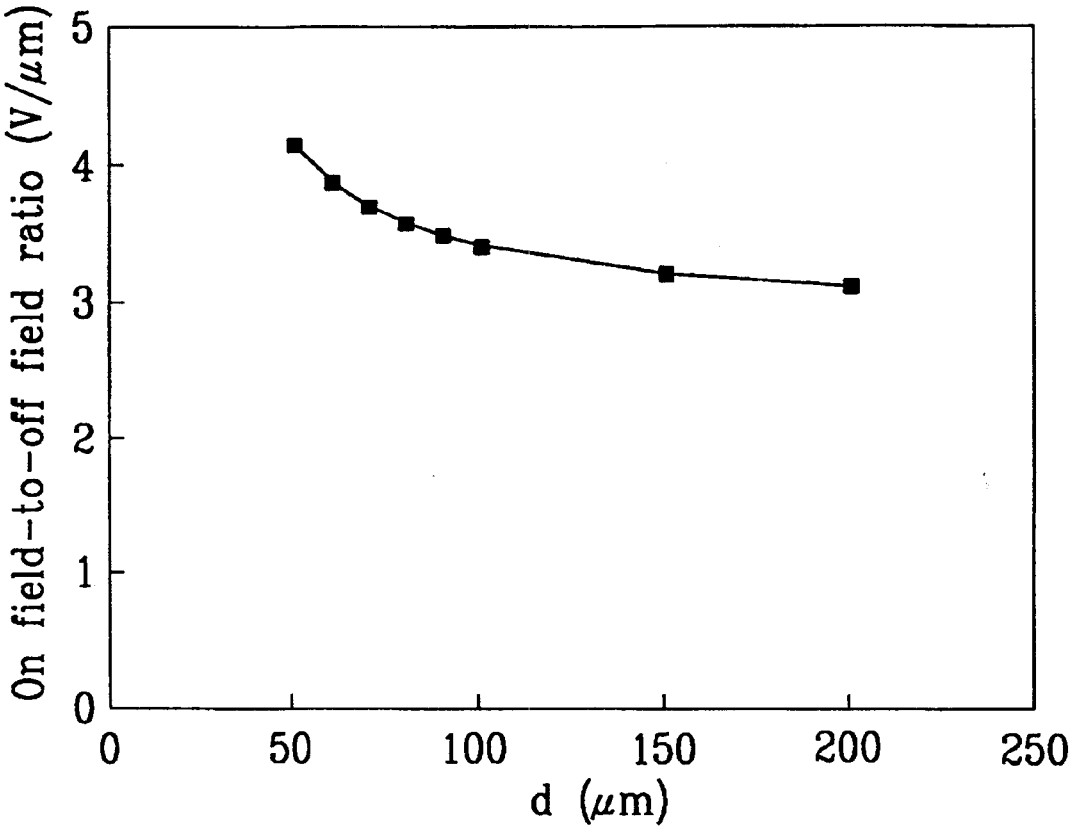
FIG. 3 is a graph showing the relationship between an On field to Off field ratio and a distance between cathode electrodes and counter electrodes according to the present invention.

FIG. 3 is a graph showing the relationship between an On field to Off field ratio (i.e., the ratio between the strength of the electric field formed on the cathode electrodes 10 when the same are On to the strength of the electric field formed on the cathode electrodes 10 when the same are Off) and the distance (d) between the cathode electrodes 10 and counter electrodes 14 referring to the calculations presented in Table 1.

As shown in FIG. 3, the On field to Off field ratio increases as the distance (d) decreases. This indicates that a sufficient electric field for the emission of electrons from the emitters 12 may be generated even with a reduce gate voltage if a suitable distance (d) is selected. It is preferable that the distance (d) is between 50 μm and 150 μm.

The counter electrodes 14 have roughly the same height as that of the cathode electrodes 10. However, the first preferred embodiment of the present invention is not limited in this respect.

Figure 4:
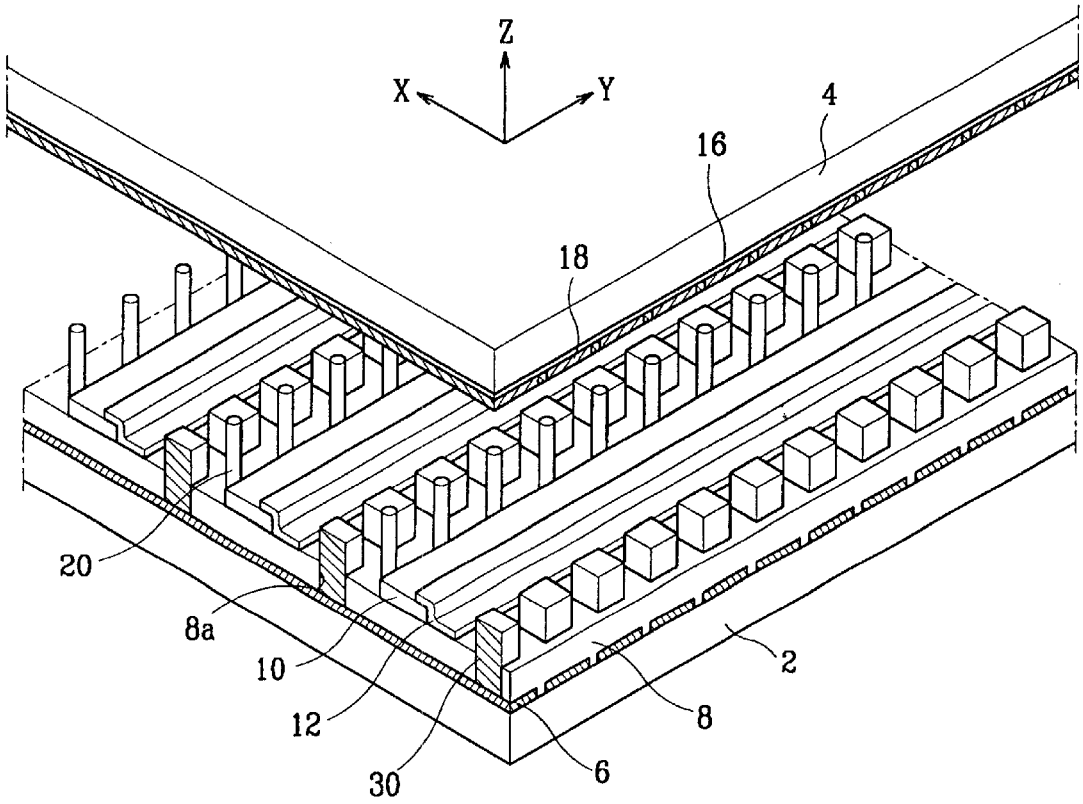
FIG. 4 is a partial perspective view of a field emission display according to a second preferred embodiment of the present invention.

FIG. 4 shows a partial perspective view of a field emission display according to a second preferred embodiment of the present invention.

In the second embodiment, the counter electrodes are different from the first embodiment. Thus, same reference numerals as the first preferred embodiment are used for all elements other than the counter electrodes.

As shown in the drawing, counter electrodes 30, as in the first preferred embodiment, are mounted between the cathode electrodes 10 and are electrically connected to the gate electrodes 6, through the holes 8*a* of the insulation layer 8. In the second preferred embodiment, the counter electrodes 30 form an electrical field between themselves and the emitters 12 and emit electrons.

However, in the second preferred embodiment of the present invention, the counter electrodes 30 have a cross-sectional area that is slightly smaller than the holes 8*a* such that the counter electrodes 30 pass through the holes 8*a* to contact the gate electrodes 6. Also, the counter electrodes 30 have a profile preferably higher than that of the cathode electrodes 10. It is preferable that the counter electrodes 30 are formed using a plating process.

With the counter electrodes 30 of a higher profile than the cathode electrodes 10, an electric field is formed at a higher position then both the cathode electrodes 10 and the emitters 12. This affects an initial scanning direction and speed of the electrons emitted from the emitters 12 and further improves the converging of the electron beams.

A structural relationship between the emitters and counter electrodes different from that of the above preferred embodiments will now be described. In the above preferred embodiments, opposing surfaces of the emitters and counter electrodes were smoothly formed. However, in the following preferred embodiments, these surfaces are formed in a particular manner.

Figure 5:
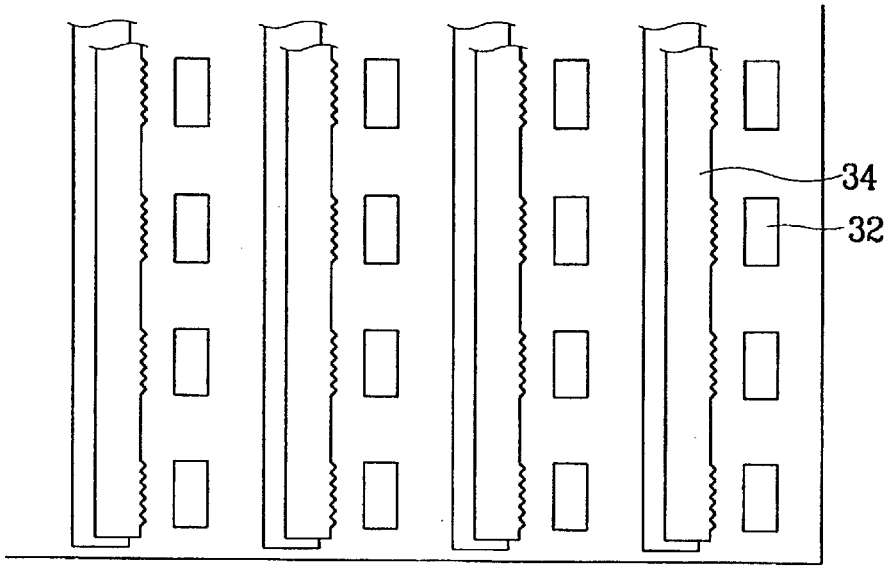
FIG. 5 is a partial plan view of a field emission display according to a third preferred embodiment of the present invention.

FIG. 5 shows a partial plan view of a field emission display according to a third preferred embodiment of the present invention. A surface of counter electrodes 32 facing emitters 34 are smoothly formed as in the above preferred embodiments. However, surfaces of the emitters 34 facing the counter electrodes 32 are formed like a saw-tooth.

Figure 6:
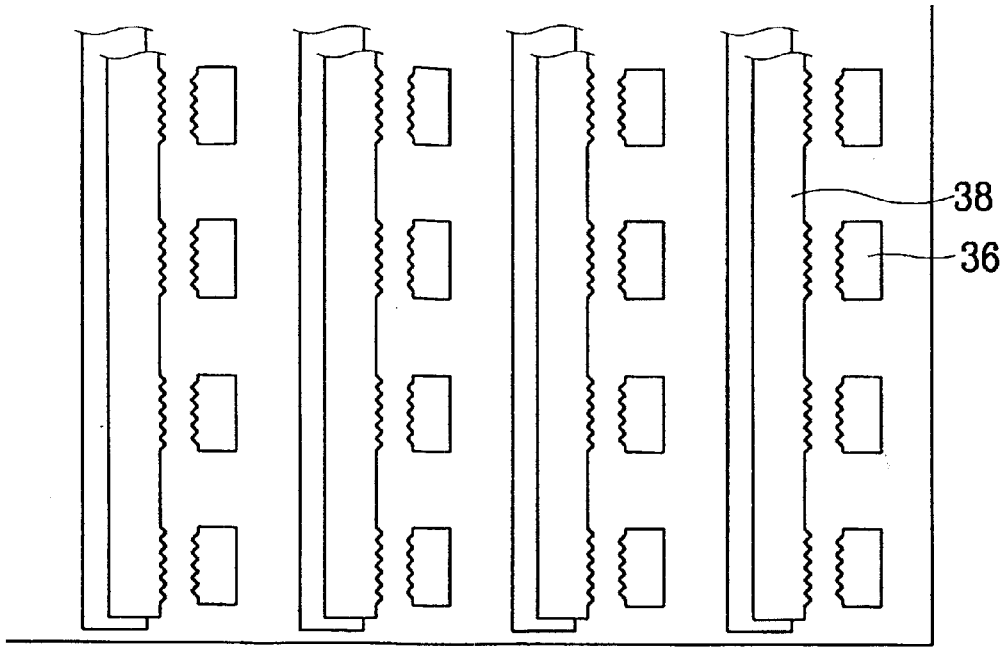
FIG. 6 is a partial plan view of a field emission display according to a fourth preferred embodiment of the present invention.

FIG. 6 shows a partial plan view of a field emission display according to a fourth preferred embodiment of the present invention. In the fourth preferred embodiment, both the surfaces of counter electrodes 36 facing emitters 38 and surfaces of the emitters 38 facing the counter electrodes 36 are formed like a saw-tooth in the same manner.

In the third embodiment and the fourth preferred embodiment, a distance between the counter electrodes and the cathode electrodes becomes shorter only at specific points. The shorter distance generates a stronger electric field. Therefore, the counter electrodes function more effectively.

Figure 7:
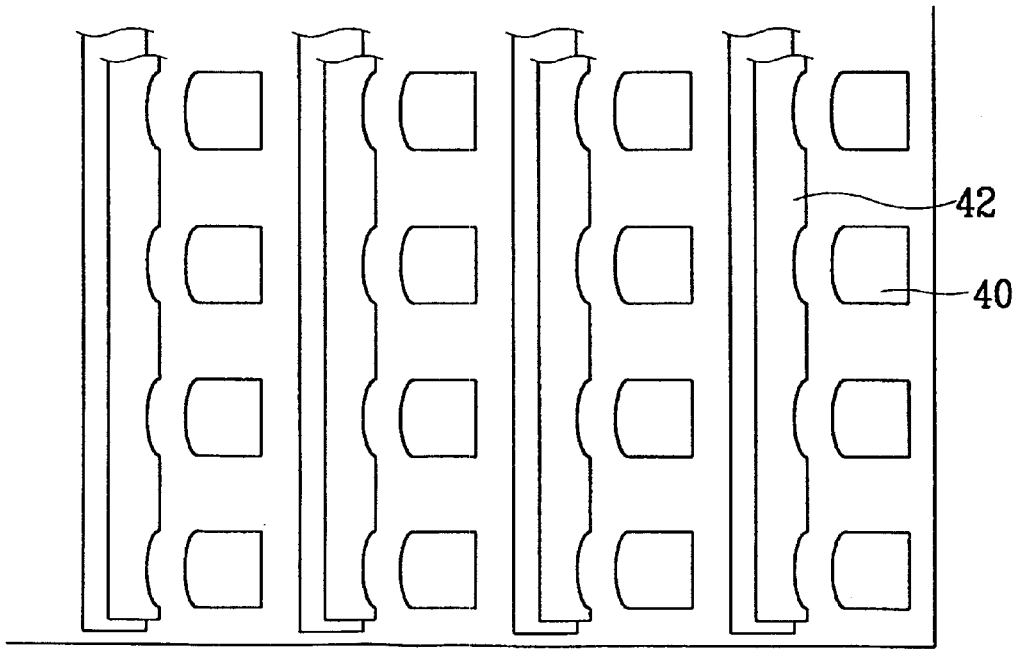
FIG. 7 is a partial plan view of a field emission display according to a fifth preferred embodiment of the present invention.

FIG. 7 shows a partial plan view of a field emission display according to a fifth preferred embodiment of the present invention. As shown in the drawing, surfaces of counter electrodes 40 facing emitters 42 and surfaces of the emitters 42 facing the counter electrodes 40 are rounded. That is, the surfaces of the counter electrodes 40 facing the emitters 42 are convex-shaped, while the surfaces of the emitters 42 facing the counter electrodes 40 are concave-shaped.

This formation of the counter electrodes 40 and the emitters 42 increases the probability of the electrons converging toward a center of the phosphor material when electrons emitted from edges of the emitters 42 are converged to phosphor material of a single pixel region (not shown). It prevents the electrons for a specific pixel region from converging onto phosphor material of an adjacent pixel region.

In the FED of the present invention, the counter electrodes are provided between the cathode electrodes and connected to the gate electrodes. It forms an electric field with the emitters and supplements the electric field formed by the gate electrodes. This increases the electric field that induces the electron emission and forms the desired electric field emission with a reduced driving voltage for the gate electrodes. This also ensures that good picture quality is maintained.

Although preferred embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. A field emission display, comprising:

a first substrate;

a gate electrode formed on said first substrate in a first direction;

an insulating layer covering the gate electrode;

a cathode electrode formed on said insulating layer in a second direction;

an emitter formed on a cathode;

a counter electrode formed on said insulating layer at a distance apart from said emitter and coupled to said gate electrode;

a second substrate; and an anode electrode formed on said second substrate, wherein said first substrate are attached to said second substrate substantially parallel to each other, wherein said cathode electrode and said counter electrode face said anode electrode, and wherein a gap is maintained evenly between said first substrate and said second substrate.

2. The field emission display of claim 1, wherein the first direction is perpendicular to the second direction.

3. The field emission display of claim 2, wherein said counter electrode is coupled to said gate electrode via a hole through said insulating layer.

4. The field emission display of claim 3, wherein the hole is formed by a photolithography method.

5. The field emission display of claim 3, wherein the hole is formed by a printing method.

6. The field emission display of claim 3, wherein said emitter is made of a carbon-based material.

7. The field emission display of claim 6, wherein the distance between said cathode and said counter electrode is between 50 $\mu$m and 150 $\mu$m.

8. The field emission display of claim 6, wherein said emitter and said counter electrode have similar heights.

9. The field emission display of claim 6, wherein an edge of said emitter facing said counter electrode is concave and an edge of said counter electrode facing said emitter is convex.

10. The field emission display of claim 6, wherein an edge of said emitter facing said counter electrode is convex and an edge of said counter electrode facing said emitter is concave.

11. The field emission display of claim 6, wherein said counter electrode is formed by electroplating.

12. The field emission display of claim 6, wherein said anode electrode is a transparent conductive layer such as indium tin oxide (ITO).

13. The field emission display of claim 6, wherein the carbon-based material is one of carbon nanotubes, Fullerene ($C_{60}$), diamond, diamond-like carbon (DLC), or a combination of these materials.

14. The field emission display of claim 6, wherein said emitter is formed in a stripe pattern on said cathrode electrode.

15. The field emission display of claim 6, wherein said emitter is formed as a separate island shape corresponding to said counter electrode.

16. The field emission display of claim 6, wherein said emitter is fabricated by a screen printing method.

17. The field emission display of claim 6, wherein said emitter is fabricated by a chemical vapor deposition method, or a sputtering method.

18. The field emission display of claim 6, wherein said counter electrode is higher than said emitter.

19. The field emission display of claim 18, wherein said counter electrode is formed by a plating process.

20. The field emission display of claim 6, wherein an edge of said emitter facing said counter electrode is shaped like a saw-tooth.

21. The field emission display of claim 20, wherein an edge of said counter electrode facing said emitter is shaped like a saw-tooth.

22. A method for driving a field emission display having a first substrate with a gate electrode, a cathode electrode insulated from the gate electrode, an emitter contacting the cathode electrode, a counter electrode coupled to the gate electrode and a second substrate with an anode electrode, comprising steps of:

forming an electronic field between the gate electrode and the cathode electrode;

enhancing the electronic field by applying a voltage to the counter electrode;

emitting electrons from the emitter by forming the electronic field around the emitter.

23. The method of claim 22, wherein the voltage applied to the counter electrode is the voltage applied to the gate electrode.

* * * * *